US006134886A

United States Patent [19]

Bussmann et al.

[11] Patent Number: 6,134,886

[45] Date of Patent: Oct. 24, 2000

[54] EXHAUST MANIFOLD

[75] Inventors: Johannes Bussmann, Warburg; Andreas Fritz, Altenbeken; Jürgen Kleinschmidt, Beverungen, all of Germany

[73] Assignee: Benteler AG, Paderborn, Germany

[21] Appl. No.: 09/168,503

[22] Filed: Oct. 8, 1998

[30] Foreign Application Priority Data

Jan. 29, 1998 [DE] Germany ..... 198 03 275

[51] Int. Cl.[7] ..... F01N 7/10

[52] U.S. Cl. ..... 60/323; 60/332

[58] Field of Search ..... 60/323, 322, 272; 285/144, 145, 223

[56] References Cited

U.S. PATENT DOCUMENTS 4,179,884 12/1979 Koeslin ..... 60/321
4,644,747 2/1987 Peterson ..... 60/322
4,831,824 5/1989 Fukazawa ..... 60/322
5,159,811 11/1992 Hefler et al. ..... 60/322
5,682,741 11/1997 Augustin et al. ..... 60/323
5,689,954 11/1997 Blöcker et al. ..... 60/322
5,765,878 6/1998 Bonny et al. ..... 285/123.1

*Primary Examiner*—Thomas Denion
*Assistant Examiner*—Binh Tran
*Attorney, Agent, or Firm*—Friedrich Kueffner

[57] ABSTRACT

An exhaust manifold includes a curved end portion and at least two T-shaped portions connected to the curved portion through sliding fits, wherein the end portion and the T-shaped portions each are provided with a flange connection and a pipe connection, and wherein each T-shaped portion has a sliding fit connection piece. Each sliding fit connection piece is shaped by internal high pressure shaping at the outer radius of a curved section of the T-shaped portion.

2 Claims, 1 Drawing Sheet

EXHAUST MANIFOLD

BACKGROUND OF THE INVENTION

1. Field of the Invention

The present invention relates to an exhaust manifold including a curved end portion and at least two T-shaped portions connected to the curved portion through sliding fits, wherein the end portion and the T-shaped portions each are provided with a flange connection and a pipe connection, and wherein each T-shaped portion has a sliding fit connection piece.

2. Description of the Related Art

In an exhaust manifold of the above-described type, the flange connections of the T-shaped portions as well as of the end portion are connected to a head flange for connecting the exhaust manifold to a motor. In order to facilitate an expansion compensation, the end portion and the T-shaped portions are connected to each other through sliding fits. For this purpose, the sliding fit connection of a T-shaped portion engages over the end of the pipe connection of the end portion or over the end of the pipe connection of an adjacent T-shaped portion.

The T-shaped portions of the exhaust manifold are manufactured from a straight piece of pipe. For this purpose, using hydraulic high internal pressure, a connection piece-shaped bulge is produced which protrudes essentially perpendicularly from the pipe axis. This connection piece-shaped bulge is opened at the end thereof by means of a sawing cut. In this manner, the flange connection is manufactured. The sliding fit connection is formed by an end of the exit pipe.

The configuration described above has the disadvantage that the length of the flange connection is limited because of the fact that shaping is effected by means of hydraulic technology; specifically, the length is limited to at most one to two times the diameter of an exit pipe. A greater length of the flange connection could lead to an undue reduction of the thickness of the material. Consequently, the dimensions of other structural components must be adapted to the short flange length. This also makes it difficult to secure the head flange. Moreover, the assembly conditions for the exhaust manifold are impaired because the contact points for attaching the exhaust manifold to the motor are less easily accessible. Accordingly, the structural configuration and the technical use of such an exhaust manifold are limited.

SUMMARY OF THE INVENTION

Therefore, it is the primary object of the present invention to provide an exhaust manifold whose operability is improved.

In accordance with the present invention, each sliding fit connection piece is shaped by internal high pressure shaping at the outer radius of a curved section of the T-shaped portions.

Accordingly, it is the principal aspect of the invention that the sliding fit connection piece is produced by internal high pressure shaping at the outer radius of a curved section of the T-shaped portions.

A pipe bend is used for manufacturing a T-shaped portion. For manufacturing the sliding fit connection piece, initially a bulge is hydraulically produced at the outer radius of the curved section of the pipe bend. This connection piece is then opened by a sawing cut at the end of the connection piece. The sawing cut preferably extends obliquely relative to the vertical transverse plane of the bulge or the pipe connection of a T-shaped portion.

The flange connection of a T-shaped portion may have a length which is appropriate for the technical and structural requirements. This facilitates mounting of the head flange as well as the assembly of the exhaust manifold at the motor.

The length of each sliding fit connection piece may be relatively short. In practice, a ratio of the length of the sliding fit connection piece to the diameter of a curved section of about 0.3 to 0.7, preferably 0.5, has been found useful. In this manner, an advantageous manufacture of the sliding fit connection piece by hydraulic shaping technology is possible without having to expect an undue reduction of the thickness of the material.

The sliding fit between the end portion and the T-shaped portion connected to the end portion or between the T-shaped portions is ensured by sliding the respective sliding fit connection pieces together with the pipe connection. For this purpose, it is advantageous if the sliding fit connection piece engages over the respective pipe connection. This ensures a reliable guidance of the exhaust gas. In practice, it is additionally advantageous if the ends of the pipe connections extending into the sliding fit connection pieces are inclined in such a way that they are adapted to the contour of a curved piece. In this manner, it is prevented that the waste gas guidance and the flow conditions in the connected portions are impaired.

It is also within the scope of the present invention if the exhaust manifold is constructed with double walls.

The various features of novelty which characterize the invention are pointed out with particularity in the claims annexed to and forming a part of the disclosure. For a better understanding of the invention, its operating advantages, specific objects attained by its use, reference should be had to the descriptive matter in which there is illustrated preferred embodiments of the invention.

DESCRIPTION OF THE PREFERRED EMBODIMENTS

Figure 1:
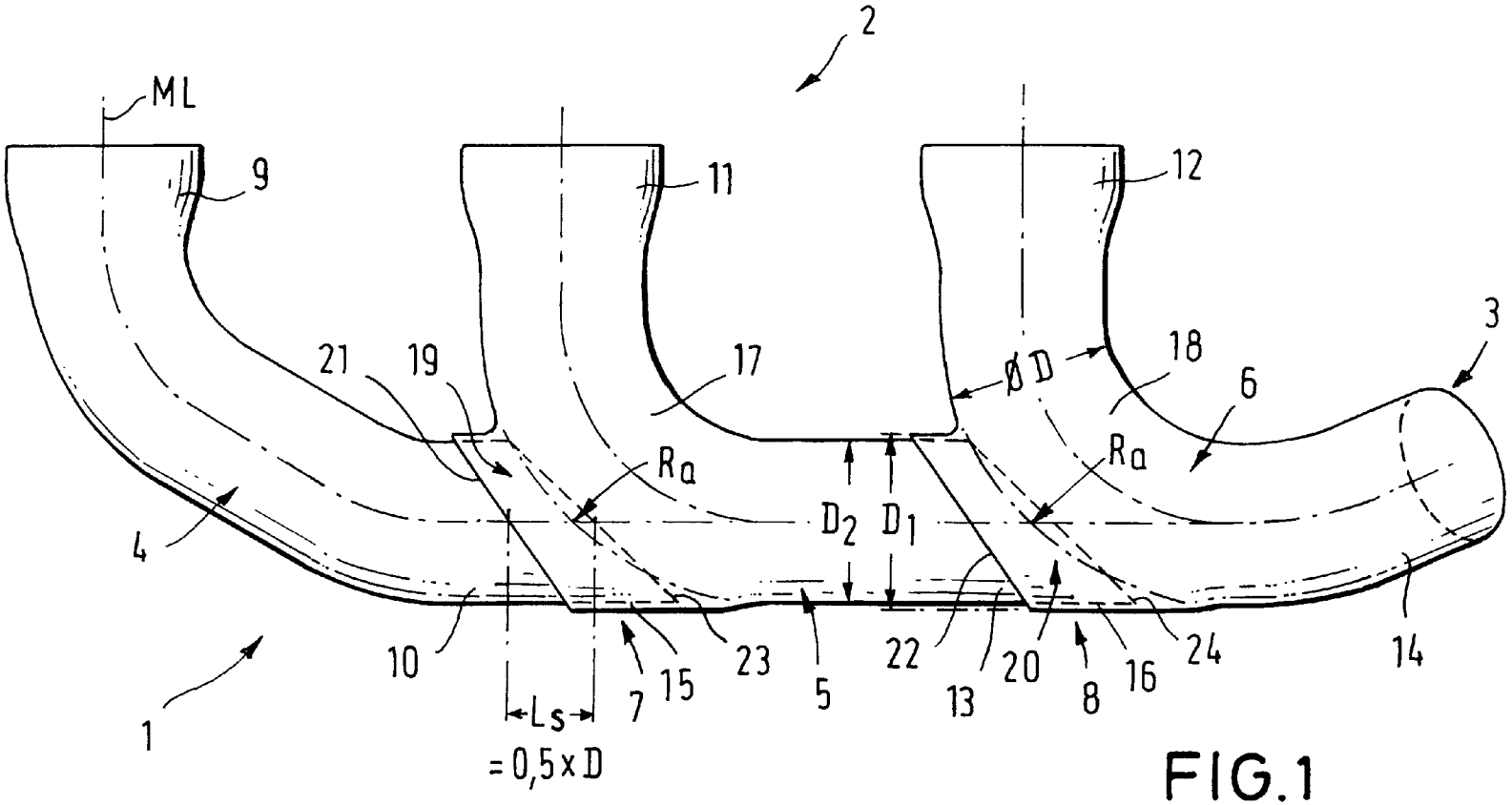
FIG. 1 is a schematic illustration of an embodiment of the exhaust manifold according to the present invention.

FIG. 1 of the drawing shows an exhaust manifold 1 with a multiple-duct inlet side 2 and a single-duct exit side 3. The exhaust manifold 1 is composed essentially of three manifold portions, i.e., a curved end portion 4 to which are connected two T-shaped portions 5 and 6. In order to facilitate an expansion or length compensation of these connected portions when exhaust gas is conducted therethrough, the end portion 4 and the T-shaped portion 5 as well as the T-shaped portion 5 and T-shaped portion 6 are connected through a sliding fit 7 and 8, respectively.

The curved end portion 4 has a flange connection 9 and a pipe connection 10. The T-shaped portions 5, 6 also each have a flange connection 11, 12, respectively, and a pipe connection 13, 14, respectively. The T-shaped portions 5, 6 additionally each have a sliding fit connection piece 15, 16, respectively.

Each T-shaped portion 5, 6 is manufactured from a pipe bend 17, 18 whose wall is bulged outwardly to form the sliding fit connection piece 15, 16.

For this purpose, a connection piece is initially formed by means of a hydraulic internal high pressure shaping at the outer radius $R_a$ of the pipe bend 17, 18 in the curved section 19, 20, located between the flange connection 11, 12 and the pipe connection 13, 14. This connection piece is then opened by a sawing cut.

As is apparent from FIG. 1, the sawing cut is carried out obliquely, so that the ends 21, 22 of the sliding fit connection pieces 15, 16 extend obliquely at an angle relative to the vertical plane. The end 23 of the pipe connection 10 and the end 24 of the pipe connection 13 are also cut at an angle. In this manner, an impairment of the flow conditions in the manifold areas 19 and 20 is avoided.

The sliding fit 7 or 8 is formed by having the sliding fit connection piece 15 of the T-shaped section 5 engage over the end of the pipe connection 10 and by having the sliding fit connection piece 16 of the T-shaped portion 6 engage over the end of the pipe connection 13 of the T-shaped section 5, wherein the sliding fit connection pieces 15 and 16 and the pipe connections 10 and 13 are each placed within one another so as to be tight with respect to media. Consequently, the diameter $D_1$, of the sliding fit connection pieces 15, 16 is greater by an appropriate extent than the diameter $D_2$ of the pipe connections 10 and 13.

The ratio of the length $L_s$, of a sliding fit connection piece 15, 16 measured along the center line ML to the diameter D of a pipe bend 17, 18, to which $D_2$ corresponds, is 0.5.

For completing the assembly of an exhaust manifold 1, a head flange, not shown, is secured at the inlet side 2. The diameter of the flange connections 9, 11 and 12 expands or widens toward the head flange. Connected to the exit side 3, also through a sliding fit, is an exhaust pipe or an intermediate pipe with a head flange at an end thereof.

While specific embodiments of the invention have been described in detail to illustrate the inventive principles, it will be understood that the invention may be embodied otherwise without departing from such principles.

We claim:

1. An exhaust manifold comprising a curved end portion, a first T-shaped portion connected through a sliding fit to the curved end portion, and at least one additional T-shaped portion connected through a sliding fit to the first T-shaped portion, wherein the end portion and the T-shaped portions each have a flange connection and a pipe connection, wherein each T-shaped portion is comprised of a pipe bend having a curved section, wherein each T-shaped portion has a sliding fit connection piece, wherein each sliding fit connection piece is shaped at an outer radius of the curved section of the T-shaped portion by internal high-pressure shaping, wherein the sliding fit connection pieces have ends extending at an incline relative to a central axis of the sliding fit connection pieces, wherein the pipe connections have ends extending at an incline relative to a central axis of the pipe connections, wherein each sliding fit connection piece has a length and each pipe bend has a diameter, and wherein a ratio of the length of the sliding fit connection piece to the diameter of the pipe bend is approximately 0.5.

2. The exhaust manifold according to claim 1, wherein the sliding fit connection piece of the first T-shaped portion engages over the pipe connection of the end portion, and wherein the sliding fit connection piece of the additional T-shaped portion engages over the end of the pipe connection of the first T-shaped portion.

* * * * *